US008241827B2

(12) United States Patent
Yasukawa et al.

(10) Patent No.: US 8,241,827 B2
(45) **Date of Patent: *Aug. 14, 2012**

(54) ELECTROSTATIC IMAGE DEVELOPING TONER

(75) Inventors: Hiroyuki Yasukawa, Tokyo (JP); Mikio Kouyama, Tokyo (JP); Kenji Hayashi, Tokyo (JP); Tomoko Sakimura, Tokyo (JP); Hiroaki Obata, Tokyo (JP); Natsuko Kusaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 987 days.

This patent is subject to a terminal disclaimer.

(21) Appl. No.: 11/872,799

(22) Filed: Oct. 16, 2007

(65) Prior Publication Data

US 2008/0171278 A1 Jul. 17, 2008

(30) Foreign Application Priority Data

Dec. 21, 2006 (JP) ..... 2006-344035

(51) Int. Cl.
*G03G 13/08* (2006.01)

(52) U.S. Cl. ..... 430/123.57; 430/107.1; 430/108.24; 430/123.5

(58) Field of Classification Search ..... 430/59.4, 430/82, 107.1, 108.24, 123.5, 123.57
See application file for complete search history.

(56) References Cited

U.S. PATENT DOCUMENTS

| | | | | |
|---|---|---|---|---|
| 3,094,536 | A * | 6/1963 | Kenney et al. | 540/128 |
| 4,311,775 | A * | 1/1982 | Regan | 430/37 |
| 4,578,330 | A * | 3/1986 | Regan et al. | 430/37 |
| 4,657,554 | A * | 4/1987 | Reinert et al. | 8/107 |
| 5,856,471 | A | 1/1999 | Nukada | |
| 6,136,488 | A | 10/2000 | Kushino | |
| 2005/0112491 | A1 | 5/2005 | Choi | |
| 2006/0088782 | A1 | 4/2006 | Lee | |
| 2006/0105262 | A1 * | 5/2006 | Sata et al. | 430/109.4 |

FOREIGN PATENT DOCUMENTS

| | | | |
|---|---|---|---|
| EP | 0148892 | | 3/1988 |
| JP | 59189352 | | 10/1984 |
| JP | 4-45985 | * | 2/1992 |

OTHER PUBLICATIONS

Neil B. McKeown, Phthalocyanine Material, Cambridge University, Press (1998), Chapters1-2, pp. 1-31 and Summary of Phthalocyanine nomenclature.*

* cited by examiner

*Primary Examiner* — Thorl Chea
(74) *Attorney, Agent, or Firm* — Lucas & Mercanti, LLP

(57) ABSTRACT

An electrostatic image developing toner which is capable of obtaining highly chromatic full-color images of bright color without causing perceived color contamination and exhibits superior lightfastness is disclosed, wherein the toner comprises a binding resin and a colorant, and the colorant is tetraazaporphyrin or phthalocyanine compounds such as a compound represented by the following formula:

12 Claims, 4 Drawing Sheets

ELECTROSTATIC IMAGE DEVELOPING TONER

TECHNICAL FIELD

The present invention relates to electrostatic image developing toners for use in electrophotographic image formation and in particular to electrostatic image developing toners which contain phthalocyanine compounds as a colorant.

TECHNICAL BACKGROUND

Recently, electrophotographic image formation using electrostatic image developing toners (hereinafter, also denoted simply as toners) has been applicable to full-color prints as well as monochromatic prints as typified in conventional documentation. Such full-color image forming apparatuses, which can make printed sheets as required on demand without making printing plates, as in conventional printing, have been employed mainly for short-run printing in which orders for small number of print is often received, as set forth in, for example, JP-A No. 2005-157314 (hereinafter, the term JP-A refers to Japanese Patent Application Publication).

When making full-color prints used for catalogues or printed advertisements by using toners, color reproduction of images faithful to the original is required in the toners. In full-color image formation, yellow, magenta and cyan toner images are superimposed to reproduce a targeted color image and superior color reproducibility of these toners is a basic requirement to realize faithful color reproduction.

Accordingly, there have been studied colorants including various metal complex dyes to achieve enhanced color reproducibility of color toners.

Typical examples of colorants for color toners include copper phthalocyanine pigments. Toners using copper phthalocyanine pigments are generally used and exhibit superior lightfastness, but result in images with reflection spectrum having a higher base-line on the longer wavelength side and tend to form seemingly color-contaminated images. Accordingly, such pigments have been regarded as unsuitable for image formation demanding higher color reproduction, as typified in prints of company logos.

There were attempted efforts at improvement of copper phthalocyanine pigments to develop a toner causing no color contamination, as set forth in, for example, JP-A No. 5-239368, but these attempts have not led to sufficient reduction of color contamination.

Toners using pigments such as copper phthalocyanine pigments exhibited versatility in that image quality at a level of images formed by printing inks was achieved, but having difficulty in displaying a hue angle suitable for color reproduction of a photographic image. Instead of using copper phthalocyanine pigments, there was studied a toner containing a colorant capable of displaying a hue angle suited for color reproduction of photographic images, as set forth in JP-A Nos. 5-239368 and 2006-63171.

SUMMARY OF THE INVENTION

It is an object of the invention to provide an electrostatic image developing toner capable of obtaining highly chromatic full-color images of bright color without causing perceived color contamination and exhibiting superior lightfastness. Specifically, it is an object to provide an electrostatic image developing toner enabling to fit its hue angle to color reproduction of a photographic image and capable of forming a secondary color toner image of high chromaticity.

The foregoing problem was overcome by the following constitution.

One aspect of the invention is directed to an electrostatic image developing toner, wherein the toner comprises a binding resin and a colorant, and the colorant comprises a compound represented by any one of formulas (I)-(V):

formula (I)

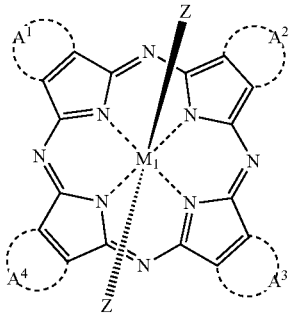

formula (II)

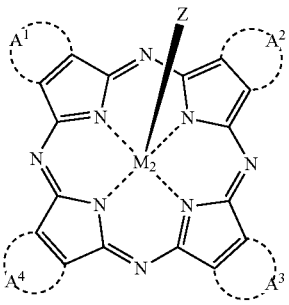

formula (III)

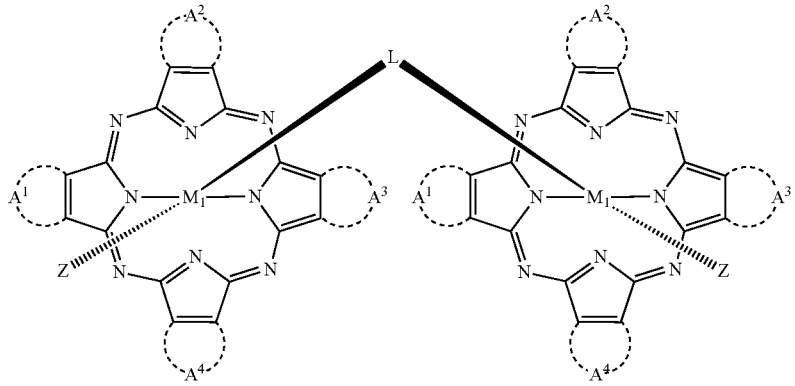

-continued formula (IV)

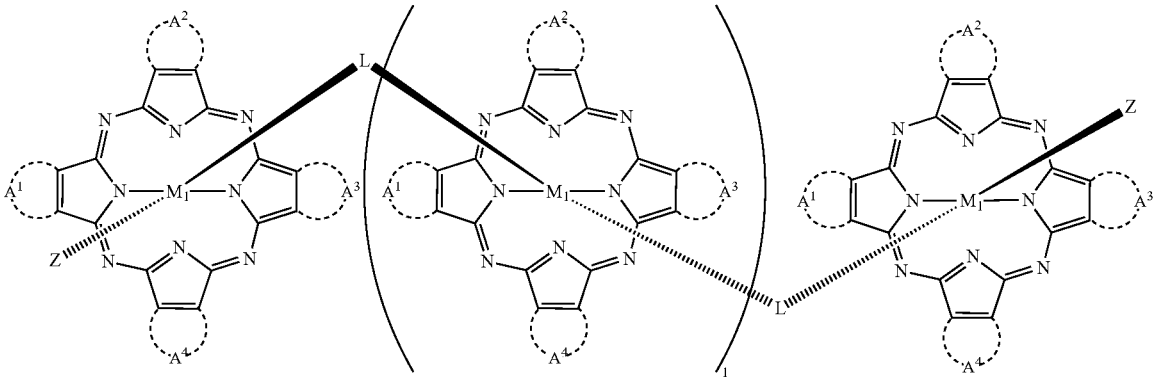

formula (V)

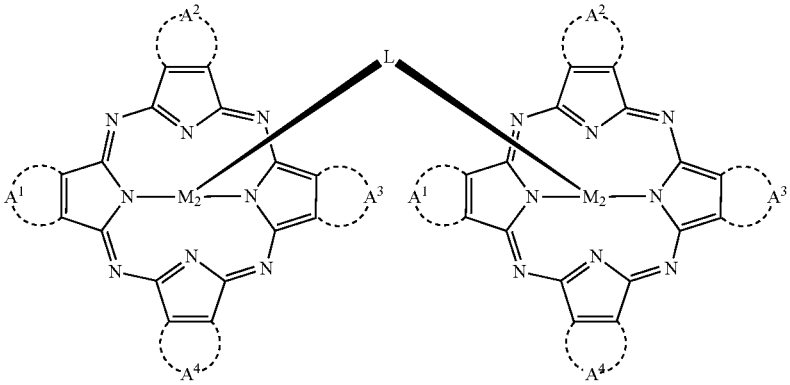

In the foregoing formulas, $M_1$ is a metal atom selected from a silicon atom (Si), a germanium atom (Ge) or a tin atom (Sn), provided that plural $M_1$s in the molecule may be the same or different.

$M_2$ is a metal atom selected from the group consisting of an aluminum atom (Al), an indium atom (In), a gallium atom (Ga) and a thallium atom (Tl).

Zs of formulas (I) to (IV) are each independently a hydroxy group, a chlorine atom, an aryloxy group having 6 to 18 carbon atoms, an alkoxy group having 1 to 22 carbon atoms or a group represented by formula (VI):

formula (VI)

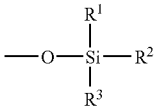

wherein $R^1$, $R^2$ and $R^3$ are each an alkyl group having 1 to 22 carbon atoms, an aryl group having 6 to 18 carbon atoms, an alkoxy group having 1 to 22 carbon atoms or an aryloxy group having 6 to 18 carbon atoms. L is an oxygen atom or —O—Si $(R)_2$—O—, in which R is an alkyl group having 1 to 4 carbon atoms, a chlorine atom or a hydroxy group.

Further, $A^1$, $A^2$, $A^3$ and $A^4$ are each independently an atomic group necessary to form a ring, as represented below, which may be substituted by an electron-withdrawing group:

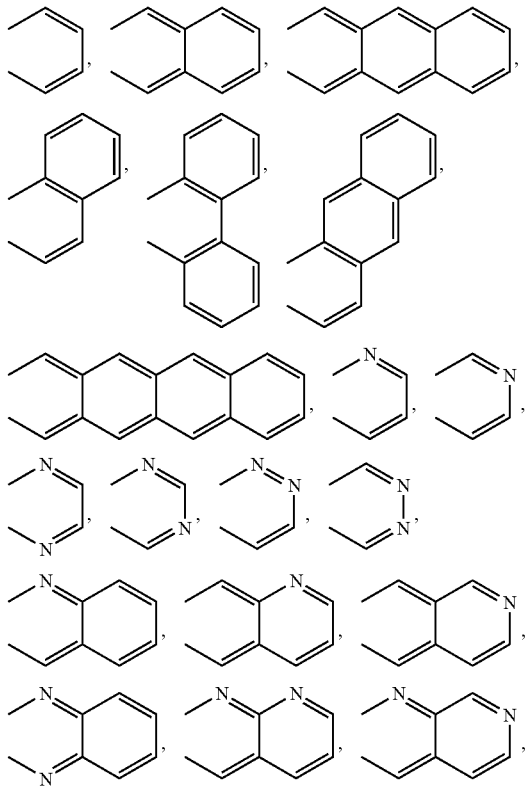

-continued

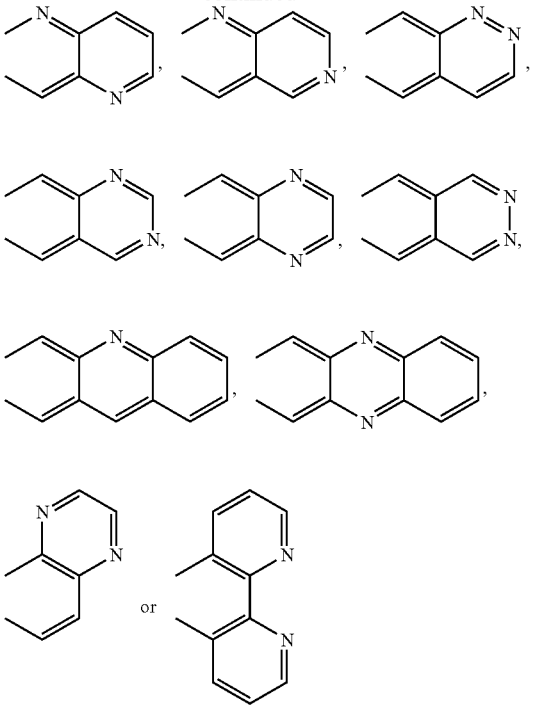

The toner relating to the invention attained highly chromatic full-color images without causing perceived color contamination and the formed toner images developed stable lightfastness over a long duration.

There have been obtained single-color toner images exhibiting superior tint with no color contamination so that secondary colors formed by the toners of the invention exhibited bright tone.

Enhanced tint enabled to allow a hue angle of a toner to fit color reproduction of a photographic image.

PREFERRED EMBODIMENTS OF THE INVENTION

Figure 1:
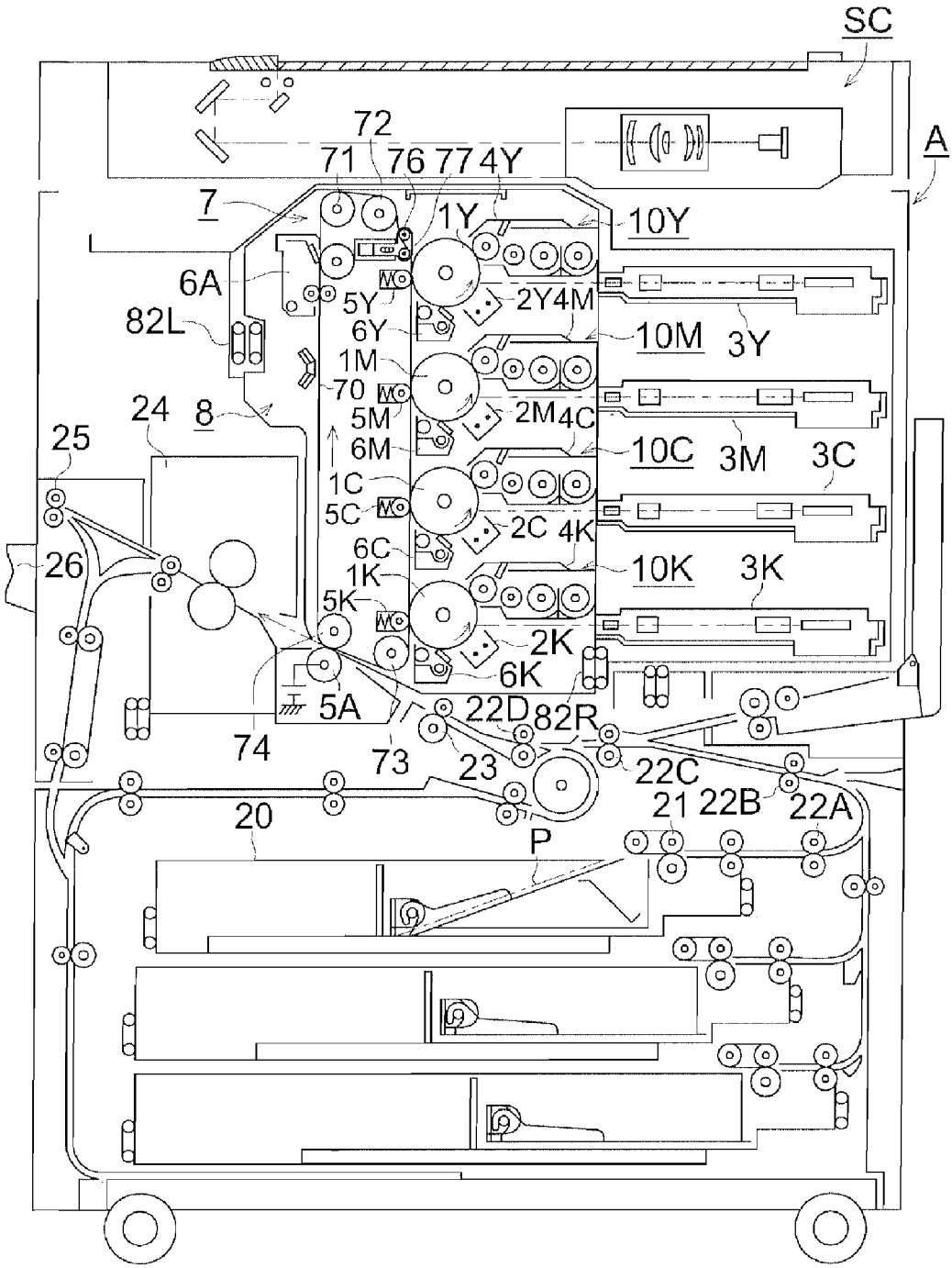
FIG. 1 illustrates an example of a full-color image forming apparatus in which the toner of the invention is usable as a two-component developer.

The invention is related to an electrostatic image developing toner comprising at least a resin and a colorant and in particular to an electrostatic image developing toner exhibiting superior color tone enabling to allow a hue angle of a toner to fit photographic image color reproduction and stable lightfastness.

The toner of the invention enabled to develop superior color with no color contamination. The reason for achieving superior colors is presumed to be that crystallinity of the colorant of the invention is weaker than that of conventional colorants such as copper phthalocyanine pigments. Thus, low crystallinity renders it easy to disperse a colorant homogeneously within the toner particle. Accordingly, melting of the toner in fixing results in uniform dispersion of the colorant on a transfer sheet, leading to color images with no contamination. Even when forming a toner image of secondary color, multi-color colorants are presumed to be homogeneously dispersed, whereby a secondary color with no contamination is obtained.

It is presumed that this low crystallinity also results in relatively high solubility, so that, for instance, in the case when producing a toner through a polymerization process, enhanced dispersibility in toner particles or in a resin particle dispersion at the time of coalescence results in homogeneous dispersion of the colorant in toner particles.

It is further presumed that in the toner relating to the invention, a colorant is uniformly dispersed in toner particles or on the fixed image, whereby color is developed with no contamination and a stable structure of the colorant molecule results in sufficient lightfastness.

Expected from the colorant being uniformly dispersed within toner particles or on the fixed image is a relatively high molecular extinction coefficient, whereby a sufficiently high image density can be obtained at a small amount of a colorant. It is therefore supposed that reduction of toner consumption in image formation is also feasible.

There will be further detailed the invention.

The toner of the invention comprises at least a resin and a colorant and the colorant contained in the toner of the invention comprises a compound represented by any one of formulas (I) to (V):

formula (I)

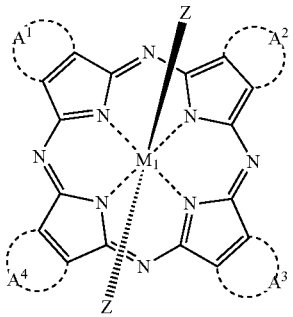

formula (II)

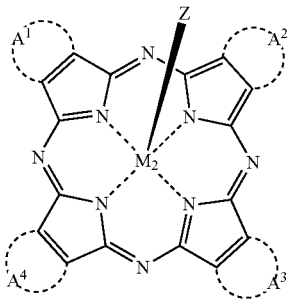

-continued formula (III)

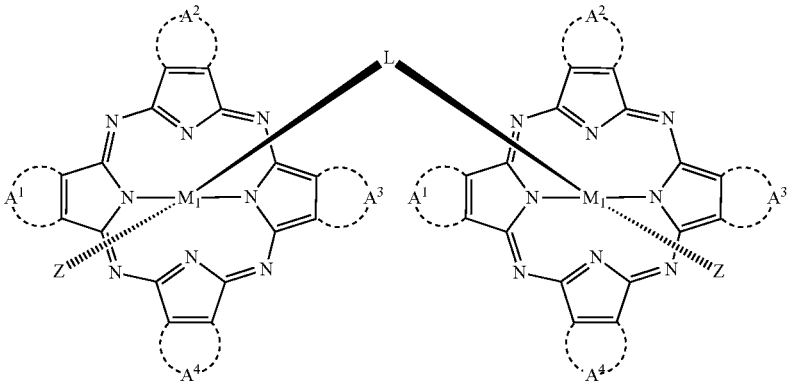

formula (IV)

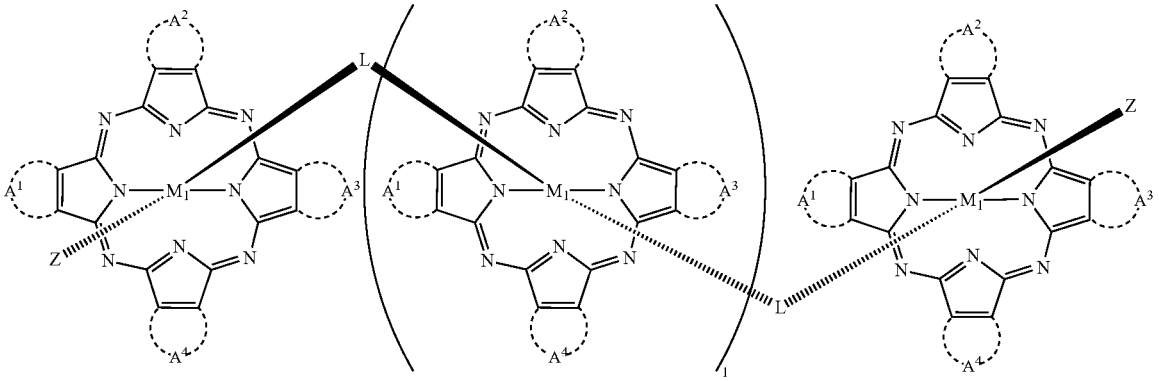

formula V)

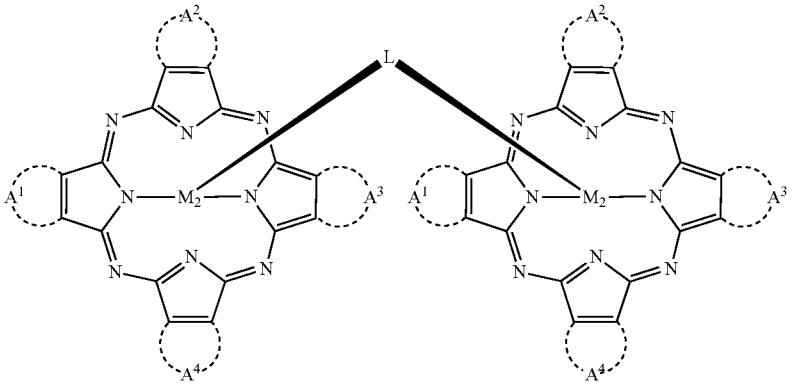

In formulas (I), (III) and (IV), $M_1$ is each a metal atom of a silicon atom (Si), a germanium atom (Ge) and a tin atom (Sn), provided that when plural $M_1$s contained in the molecule, they may be the or different.

In formulas (II) and (V), $M_2$ is a metal atom selected from the group consisting of an aluminum atom (Al), an indium atom (In), gallium atom (Ga) and thallium (Tl). Of these are preferred an indium atom (In) and gallium atom (Ga).

Z of each of formulas (I) to (IV) is independently a hydroxy group, a chlorine atom, an aryloxy group having 6 to 18 carbon atoms, an alkoxy group having 1 to 22 carbon atoms or a group represented by formula (VI):

formula (VI)

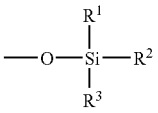

wherein $R^1$, $R^2$ and $R^3$ are each an alkyl group having 1 to 22 carbon atoms, an aryl group having 6 to 18 carbon atoms, an alkoxy group having 1 to 22 carbon atoms or an aryloxy group having 6 to 18 carbon atoms. The number of an alkyl group or alkoxy group is preferably 1 to 10, and more preferably 1 to 8 and that of an aryl group or aryloxy group is preferably 6 to 10, and more preferably 6 to 8.

In formulas (III), (IV) and (V), L is an oxygen atom, or —O—$Si(R)_2$—O—, in which R is an alkyl group having 1 to 4 carbon atoms, a chlorine atom or a hydroxy group.

In formulas (I) through (V), $A^1$, $A^2$, $A^3$ and $A^4$ are each independently an atomic group necessary to form an aromatic ring which may be substituted by an electron-withdrawing group, and such an atomic group is represented by formulas (1)-(29), as below. The atomic groups of (1) to (29), each combines a pyrrole ring at the 3- and 4-position of the pyrrole ring to form an ring condensed with the pyrrole ring, as represented by formulas (I)-(V).

(1)

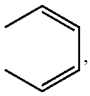

(2)

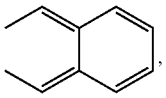

(3)

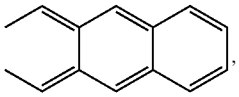

(4)

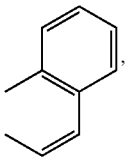

(5)

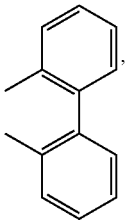

(6)

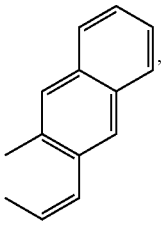

(7)

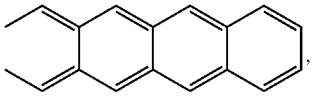

(8)

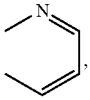

-continued (9)

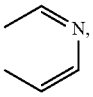

(10)

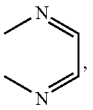

(11)

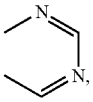

(12)

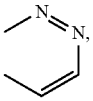

(13)

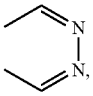

(14)

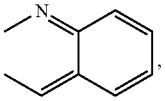

(15)

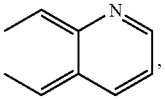

(16)

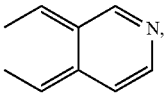

(17)

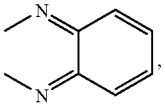

(18)

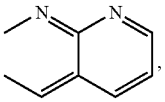

(19)

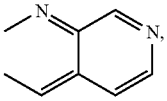

(20)

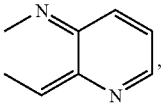

(21)

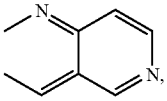

(22)

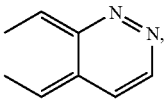

-continued (23)

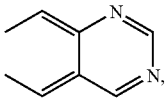

(24)

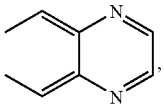

(25)

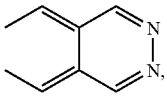

(26)

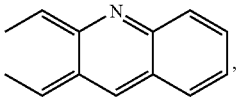

(27)

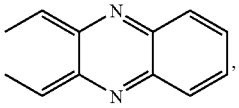

(28)

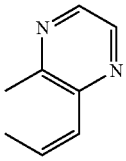

(29)

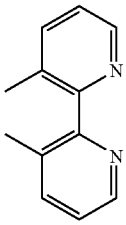

The toner of the invention contains a compound represented by formulas (I) through (V), and a compound of formula (I), (III) or (V) is preferred and a tetraazaporphyrin compound of formula (I), that is, a phthalocyanine compound having an axial ligand is specifically preferred.

Toners using the compound of formula (I), (III) or (IV) as a colorant develops superior color reproduction, compared to a phthalocyanine compound represented by formula (II), not having an axial ligand. Specifically, a toner using a tetraazaporphyrin markedly exhibits such tendency. It is presumed that the compounds of formulas (I), (III) and (IV) are more complex in structure than the compound of formula (II), which renders it difficult to be coagulated or crystallized, whereby such a colorant compound is easily dispersed uniformly in toner particles or on a fixed image, leading to enhanced color reproduction.

A colorant, of which structure is difficult to be coagulated or crystallized, results in enhancement of compatibility with a binder resin or solubility in a solvent or a polymerizable monomer, whereby the colorant is easily homogeneously dispersed in the process of producing a toner, leading to superior color reproduction.

Z constituting the compounds of formulas (I) to (IV) is preferably a group represented by the formula (VI) among groups described earlier. In the formula (VI), $R^1$, $R^2$ and $R^3$ are each preferably an alkyl group having 1 to 6 carbon atom, an aryl group or an alkoxy group, and a n-propyl, iso-propyl, n-butyl, iso-butyl or t-butyl group is preferred.

In formulas (III), (IV) and (V), L is preferably an oxygen atom among groups described earlier.

$M_1$ constituting the compounds of formulas (I), (III) and (IV), contained as a colorant in the toner of the invention is selected from a silicon atom (Si), a germanium atom (Ge) and a tin atom (Sn). Of these, a silicon atom (Si) is specifically preferred in terms of achieving superior color.

A metal atom $M_2$ constituting the compound of formulas (II) and (V) is selected from the group of a zinc atom (Zn), a manganese atom (Mn), a titanium atom (Ti), a magnesium atom (Mg), a vanadium atom (V), an aluminum atom (Al), a tin atom (Sn), an indium atom (In) and gallium atom (Ga). Of these, a vanadium atom (V), a gallium atom (Ga) and an indium atom (In) are preferred.

$A^1$, $A^2$, $A^3$ and $A^4$ constituting the compounds of formulas (I) to (V) are each independently an atomic group necessary to form an aromatic ring and preferably a benzene ring. Examples of an electron-withdrawing group capable of being attached to the aromatic ring a chlorine group (—Cl), a chlorohalogenated methyl group (—$CClX_2$), a trifluoromethyl (—$CF_3$) and a nitro group (—$NO_2$).

The afore-described colorants may be used singly or in their combination. The colorants may be used in combination with commonly known colorants. The colorant content is preferably from 1 to 30% by mass of the total of a toner, and more preferably from 2 to 20% by mass. The foregoing colorant compound is expected to exhibit relatively high molecular extinction coefficient so that superior color reproduction is possible developed at a smaller content than conventional colorants.

Specific examples of a tetraazaporphyrin compound (phthalocyanine compound having an axial ligand) of formula (I), I-1 to I-20 and a phthalocyanine compound of formula (II), II-1 to II are shown in Table 1, but compounds of formulas (I) and (II), usable in the toner of the invention are by no means limited to these.

TABLE 1

| Compound No. 1 | $M_1$, $M_2$ | $A^1, A^2, A^3, A^4$ Exemplified Atomic Group | Y | Substituent on Ring |
|---|---|---|---|---|
| I-1 | Si | example (1) | —O—$Si(CH_2CH_3)_3$ | |
| I-2 | Si | example (1) | —OH | |
| I-3 | Si | example (1) | —O—$Si(CH_2CH_2CH_3)_3$ | |
| I-4 | Si | example (1) | —O—$Si(CH_2CH_2CH_2CH_2CH_2CH_2CH_2CH_3)_3$ | |
| I-5 | Si | example (1) | —O—$Si(CH_2CH_2CH_2CH_2CH_2CH_2CH_2CH_3)(CH_3)_2$ | |
| I-6 | Si | example (1) | —O—$Si(t\text{-}C_4H_9)_3$ | |
| I-7 | Si | example (1) | —O—$Si(CH_2CH_3)_3$ | 5-chloro group |
| I-8 | Si | example (1) | —O—$Si(CH_2CH_3)_3$ | 5,6-dichloro groups |
| I-9 | Si | example (1) | —O—$Si(CH_2CH_3)_3$ | 5-trifluoromethyl group |
| I-10 | Si | example (2) | —O—$Si(CH_2CH_3)_3$ | |

TABLE 1-continued

| Compound No. 1 | $M_1$, $M_2$ | $A^1, A^2, A^3, A^4$ Exemplified Atomic Group | Y | Substituent on Ring |
|---|---|---|---|---|
| I-11 | Si | example (2) | —O—$Si(CH_2CH_3)_3$ | 5-nitro group |
| I-12 | Si | example (2) | —O—$Si(t\text{-}C_4H_9)_3$ | |
| I-13 | Sn | example (1) | —O—$Si(CH_2CH_3)_3$ | |
| I-14 | Ge | example (1) | —O—$Si(CH_2CH_3)_3$ | |
| I-16 | Si | example (1) | —O—$Si(CH_2CH_3)(CH_3)_2$ | |
| I-17 | Si | example (1) | —O—$Si(CH_3)_3$ | |
| I-18 | Ge | example (1) | —O—$Si(t\text{-}C_4H_9)_3$ | |
| I-19 | Si | example (2) | —OH | |
| I-20 | Sn | example (1) | —O—$Si(CH_2CH_2CH_3)_3$ | |
| I-21 | Si | example (1) | —O—$Si(CH_3)_3$ | |
| II-1 | Ga | example (1) | — | |
| II-2 | Al | example (1) | — | |
| II-3 | In | example (1) | — | |
| II-4 | Tl | example (1) | — | |

Specific examples of compounds of formulas (III) and (IV) are shown below but those usable in the invention are by no means limited to these.

(III-1)

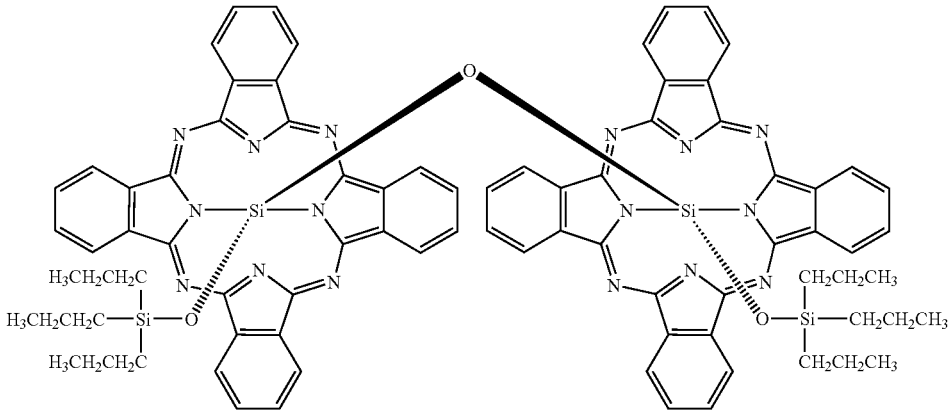

(III-2)

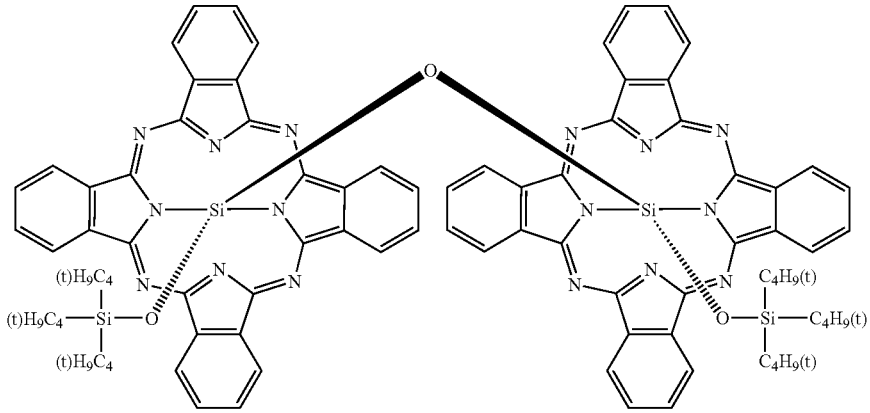

-continued
(III-3)
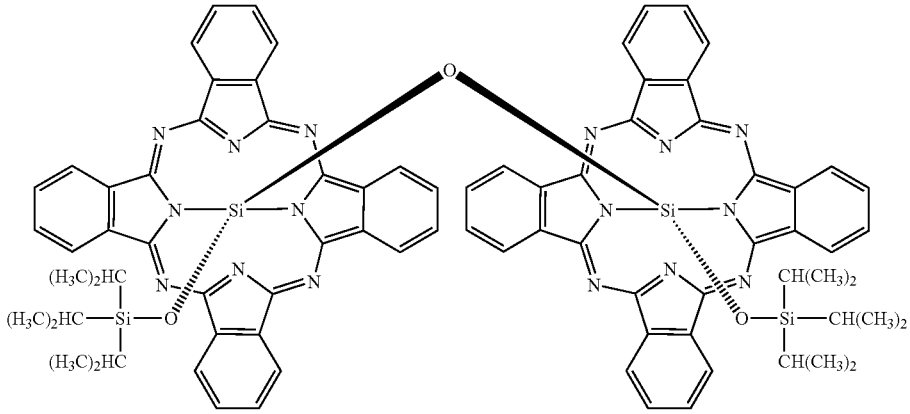
(III-4)
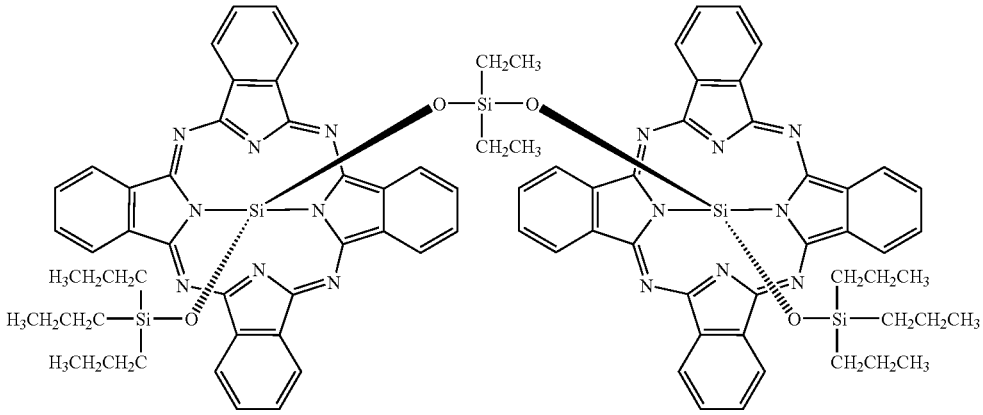
(III-5)
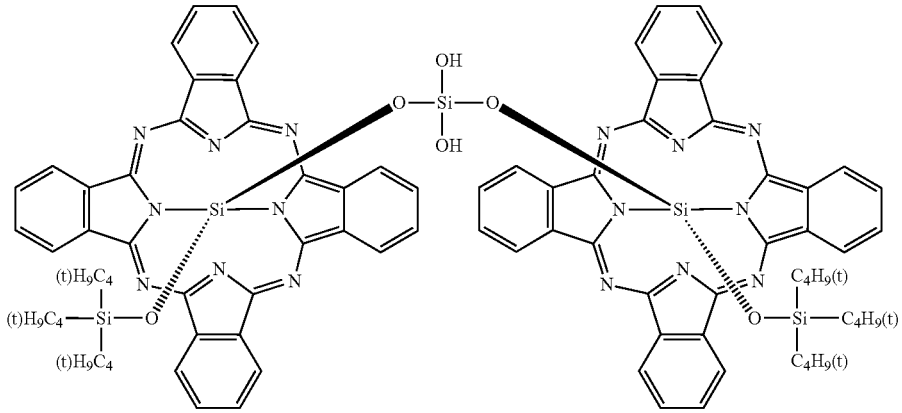
(III-6)
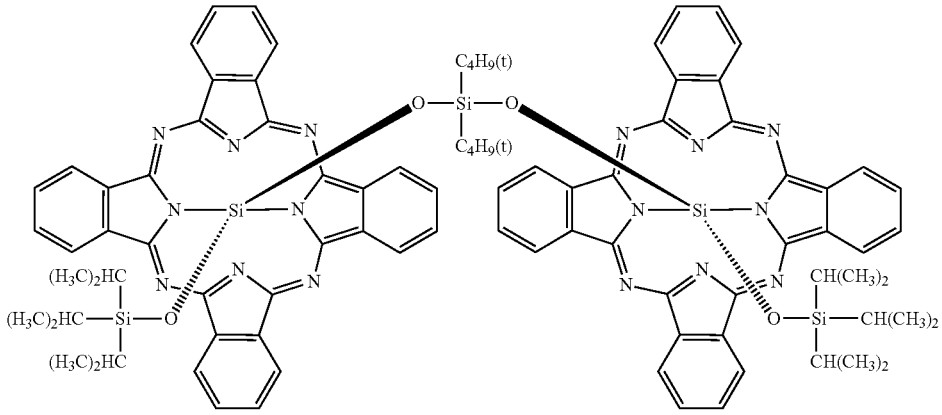

-continued (IV-1)

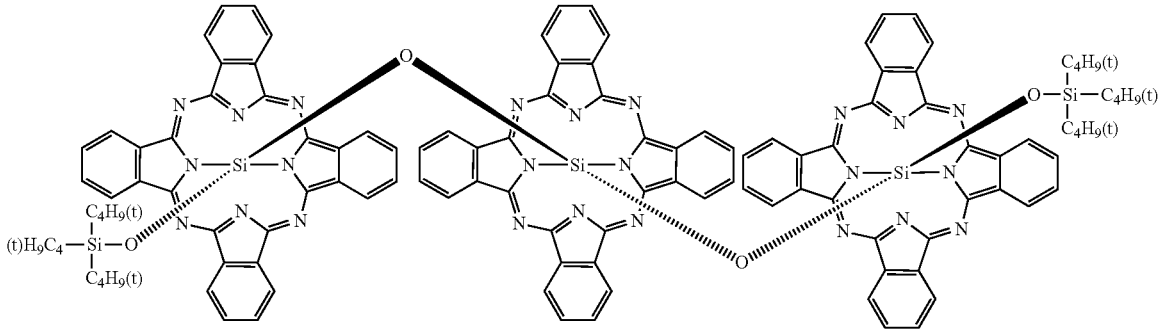

Specific examples of compounds of formula (V) are shown below but those usable in the invention are not limited to these.

(V-1)

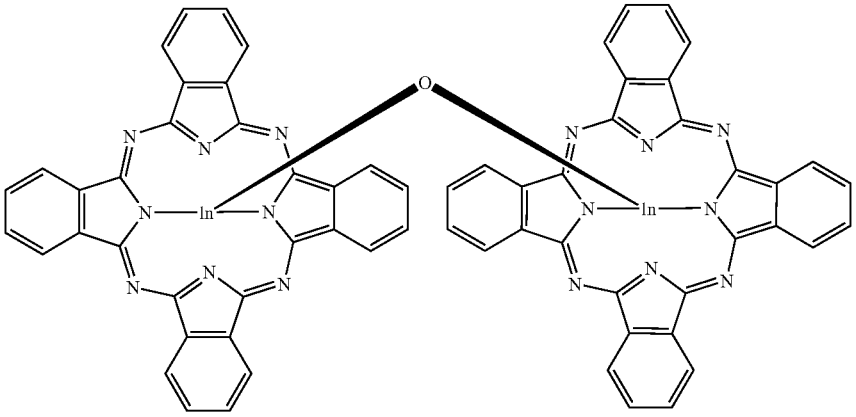

(V-2)

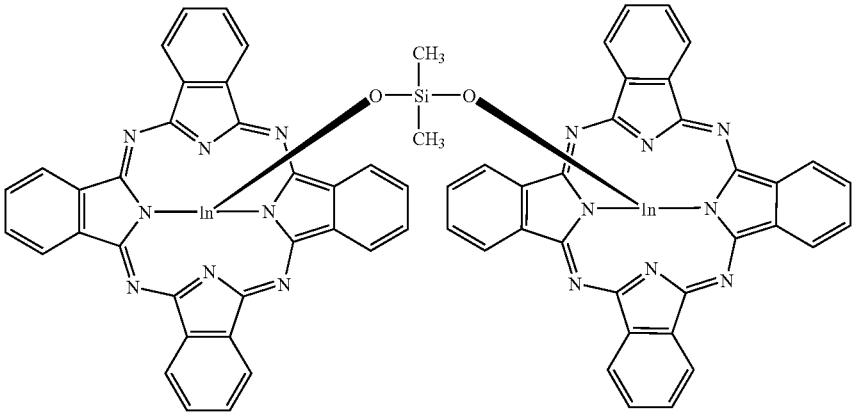

The use of the above-described colorant in the toner enabled development of broad stable color reproducibility, compared to conventional toner images or images obtained by using printing inks. Recently, there have been increased opportunities for printing images on computer displays. The color region of conventional printing is much narrower than that of a computer display, resulting in a large difference in color between an image on a display and an image printed from it. However, the use of the toner of the invention enabled to obtain a print image closer to the color region of a computer display than conventional toners. Thus, the toner of the invention can be said to contribute to the expansion of the color range of print images.

There will be further described particle size of the toner of the invention.

Toner particles relating to the invention preferably exhibit a volume-based median diameter (also denoted simply as D50v) of not less than 3 μm and not more than 8 μm. The volume-based median diameter falling within the foregoing region enables faithful reproduction of fine-dot images, for example, at a level of 1200 dpi (dpi: the number of dots per inch or 2.54 cm).

The minute particle size level at a volume-based median diameter falling within the minute particle size enables to obtain a highly precise photographic image in which a dot image constituting the photographic image is equivalent to or more than a high-precision printed image. Specifically, in on-demand printing in which orders for several hundreds to several thousands sets are often received, high image quality prints with high-precision photographic images can be delivered to a user.

The volume-based median diameter (D50v) of toner particles can be determined using Coulter Multisizer 3 (Beckmann Coulter Co.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed by an ultrasonic homogenizer to prepare a toner dispersion. Using a pipette, the toner dispersion is poured into a beaker having ISOTON II (produced by Beckman Coulter Co.) within a sample stand, until reaching a measurement concentration of 5 to 10%. The measurement count was set to 2,500 to perform measurement. Then aperture diameter of Multisizer 3 was 50 μm.

The toner of the invention preferably exhibits a coefficient of variation (CV value) of volume-based particle size distribution of not less than 2% and not more than 21%, more preferably not less than 5% and not more than 15%. The coefficient of variation (CV value) of volume-based particle size distribution represents a dispersion degree of particle size distribution, based on volume and defined as below:

$$CV\text{ value }(\%)=\{(\text{standard deviation of number-based particle size distribution})/[\text{median diameter (D50v) of number-based particle size distribution}]\}\times 100$$

A low value indicates a sharper particle size distribution and means that the particle size tends to be uniform. Uniform particle size enables more precise reproduction of fine-dot images or fine lines, as is essential in digital image formation. Printing a photographic image with uniform-sized toner particles results in photographic images of high image quality at a level equivalent to or higher than an image prepared by printing ink.

The toner of the invention preferably exhibits a softening point at a temperature of 70 to 110° C., and more preferably 70 to 100° C. Colorants used in the toner of the invention are stable, causing no change in spectrum even when affected by heat. A softening point falling with the foregoing range can reduce effects of heat applied to the toner in fixing. Accordingly, image formation is performed without relying on a colorant, so that it is expected to, develop broad stable-color reproduction.

A toner with a softening point falling within the foregoing range enables fixing a toner image at a lower temperature than the prior art, rendering it feasible to perform image formation friendly to environments at reduced power consumption.

The softening point of a toner can be controlled by the following methods, singly or in combination. Thus, (1) the kind or the composition of monomer used for resin formation is adjusted; (2) the molecular weight of a resin is controlled by the kind or the amount of a chain-transfer agent; (3) the kind or amount of a wax is controlled.

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a 1 mm long nozzle, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

There will be described a method of preparing the toner of the invention.

The toner of the invention is comprised of particles containing at least a resin and a colorant (hereinafter, also denoted as colored particles). The colored particles constituting the toner of the invention are not specifically limited but can be prepared according the convention methods for preparing toners. More specifically, preparation is feasible by applying, for example, a so-called grinding method for preparing a toner through kneading, grinding and classification or a preparation method of a polymer toner in which a polymerizable monomer is polymerized with controlling the shape or size of particles to achieve particle formation (for example, emulsion polymerization, suspension polymerization, or polyester elongation).

When preparing the toner of the invention through a grinding method, kneading is performed with maintaining a temperature at not more than 130° C. When kneading a mixture at a temperature exceeding 130° C., heating action applied to the mixture tends to cause variation in the coagulation state of a colorant, rendering it difficult to maintain uniform colorant coagulation. It is a concern that variation in the coagulation state causes variations in color of the prepared toner, leading to color contamination.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) styrene or styrene derivatives:

styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) methacrylic acid ester derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) acrylic acid ester derivatives:

methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate;

(4) olefins:

ethylene, propylene and isobutylene;

(5) vinyl esters:

vinyl propionate, vinyl acetate and vinyl benzoate;

(6) vinyl ethers:

vinyl methyl ether and vinyl ethyl ether;

(7) vinyl ketones:

vinyl methyl ketone, vinyl ethyl ketone and vinyl hexyl ketone;

(8) N-vinyl compounds:

N-vinyl carbazole, N-vinyl indole and N-vinyl pyrrolidone;

(9) others:

vinyl compounds such as vinylnaphthalene and vinylpyridine; acrylic acid or methacrylic acid derivatives such as acrylonitrile, methacrylonitrile and acrylamide.

There may also usable polymerizable monomers containing ionic-dissociative group, as a vinyl monomer, including, for example, those having a side chain containing a functional group such as a carboxyl group, a sulfonic acid group or a phosphoric acid group.

Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido-2-methylpropanesulfonic acid; and phosphoric acid group containing monomers such as acid phosphooxyethyl methacrylate.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

Waxes usable in the toner of the invention are those known in the art. Examples thereof include (1) polyolefin wax such as polyethylene wax and polypropylene wax; (2) long chain hydrocarbon wax such as paraffin wax and sasol wax; (3) dialkylketone type wax such as distearylketone; (4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristarate, and distearyl meleate; and (5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

Spherical organic microparticles having a number-average primary particle size of 10 to 2000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a Henschel mixer, a Nauter mixer or a V-shape mixer.

The toner of the invention is usable as a two-component developer comprised of a carrier and a toner, or a single-component developer comprised of a toner alone.

The use of the toner of the invention as a two-component developer enables full-color printing by using a tandem system image forming apparatus, as described later. Further, appropriate selection of a resin and a wax constituting a toner enables full-color printing corresponding to low-temperature fixing in which a paper temperature is approximately 100° C. in fixing.

Magnetic particles used as a carrier of a two-component developer can use commonly known materials, e.g., metals such as iron, ferrite and magnetite and alloys of the foregoing metals and metals such as aluminum or lead. Of these, ferrite particles are preferred. The volume-average particle size of a carrier of a carrier is preferably from 15 to 100 μm. and more preferably from 25 to 80 μm.

When used as a nonmagnetic single-component developer without a carrier to perform image formation, a toner is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

There will be described image formation using the toner of the invention. First, there will be described image formation using the toner of the invention as a two-component developer.

FIG. 1 illustrates an example of an image forming apparatus in which the toner of the invention is usable as a two-component developer.

In FIGS. 1, 1Y, 1M, 1C and 1K each designate photoreceptors; 4Y, 4M, 4C and 4K each designate a developing means; 5Y, 5M, 5C and 5K each designate primary transfer rollers as a primary transfer means; 5A designates a secondary transfer roller as a secondary transfer means; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 as a transfer section including an endless belt form of a transfer belt, paper feeding and conveying means 22A to 22D to convey recording member P and heated roll-type fixing device 24 as a fixing means. Original image reading device SC is disposed in the upper section of image forming apparatus body A.

Image forming section 10Y to form a yellow image as one of different color toner images formed on the respective photoreceptors comprises drum-form photoreceptor 1Y as the first photoreceptor; electrostatic-charging means 2Y, exposure means 3Y and developing means 4Y which are disposed around the photoreceptor 1Y; primary transfer roller 5Y as a primary transfer means; and cleaning means 6Y.

Image forming section 10M to form a magenta image as one of different color toner images formed on the respective photoreceptors comprises drum-form photoreceptor 1M as the second photoreceptor; electrostatic-charging means 2M, exposure means 3M and developing means 4M which are disposed around the photoreceptor 1M; primary transfer roller 5M as a primary transfer means; and cleaning means 6M.

Image forming section 10C to form a cyan image as one of different color toner images formed on the respective photoreceptors comprises drum-form photoreceptor 1C as the third photoreceptor; electrostatic-charging means 2Y, exposure means 3C and developing means 4C which are disposed around the photoreceptor 1C; primary transfer roller 5C as a primary transfer means; and cleaning means 6C.

Image forming section 10K to form a black image as one of different color toner images formed on the respective photoreceptors comprises drum-form photoreceptor 1K as the fourth photoreceptor; electrostatic-charging means 2K, exposure means 3K and developing means 4K which are disposed around the photoreceptor 1K; primary transfer roller 5K as a primary transfer means; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Figure 2:
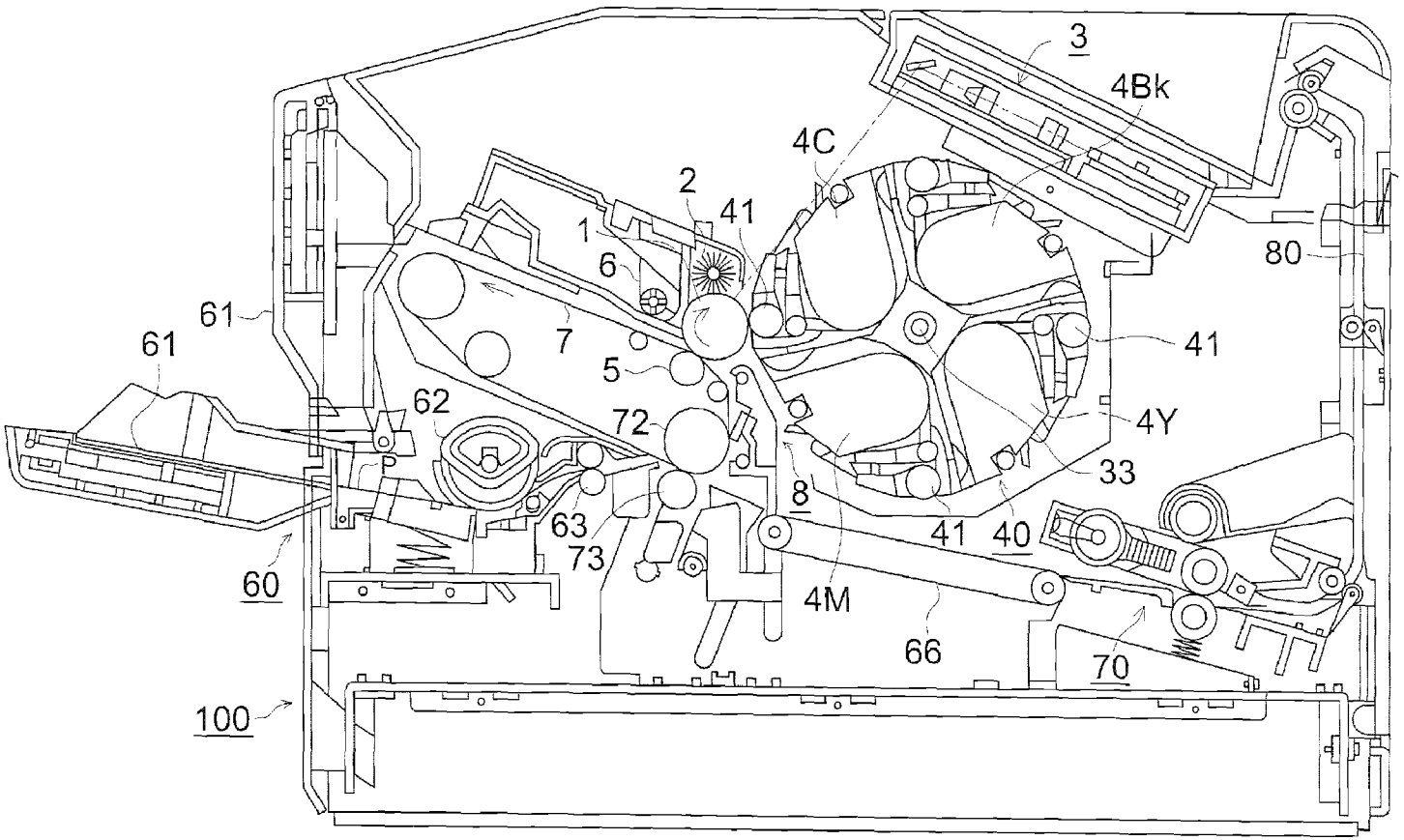
FIG. 2 illustrates an example of a full-color image forming apparatus in which the toner of the invention is usable as a single-component developer.

Image forming sections are arranged vertically in a line. Intermediate transfer material unit 7 of an endless belt form is disposed on the left side of photoreceptors 1Y, 1M, 1C and 1K, as indicated in FIG. 2. Intermediate transfer material unit 7 comprises the intermediate transfer unit (7) of an endless belt form which can be turned via rollers 71, 72, 73, 74 and 76, primary transfer rollers 5Y, 5M, 5C and 5K and cleaning means 6A.

The image forming sections 10Y, 10M, 10C and 10K and the intermediate transfer unit 7 are pulled out of the body A by pulling the housing 8.

In the process of image formation, toner images are formed on photoreceptors 1Y, 1M, 1C and 1K, through electrostatic-charging, exposure and development, toner images of the individual colors are superimposed on the endless belt form, intermediate transfer material (70), transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Next, there will be described an image forming method using the toner of the invention as a nonmagnetic single-component developer. FIG. 2 illustrates an example of a full-color image forming apparatus using a nonmagnetic single-component developer. An image forming apparatus 100 shown in FIG. 2 is a typical image forming apparatus which can be installed with the developing device. In the image forming apparatus of FIG. 2, there are provided, around a rotary-drivable electrostatic latent image bearing body 1 (hereinafter, also denoted as a photoreceptor drum 1), an electrostatic-charging brush 2 to allow the surface of the photoreceptor drum 1 to be uniformly charged to a prescribed potential and a cleaner 6 to remove any residual toner on the photoreceptor drum 1.

A laser scanning optical system 3 scanning-exposes the surface of the photoreceptor drum 1 uniformly charged by the charging brush 2 to form a latent image on the photoreceptor drum. A laser scanning optical system 3 incorporates a laser diode, a polygon mirror and an fθ optical system, with the control section of which print data for each of yellow, magenta, cyan and black are transferred from a host computer. Based on the print data for the respective colors, laser beams are successively outputted to scan the surface of the photoreceptor drum 1 to form an electrostatic latent image of each color.

A development device unit 40, housing a development device 4, supplies the individual color toners to the photoreceptor drum 1 to perform development. The development device unit 40 is provided with four development devices 4Y, 4M, 4C and 4Bk which house nonmagnetic single-component toners of yellow, magenta, cyan and black, respectively, and rotate centering around a shaft 33 to guide the individual development device 4 to the position opposing the photoreceptor drum 1.

The development device unit 40 rotates centering around the shaft 33 every time an individual electrostatic latent image is formed on the photoreceptor drum 1 by the laser scanning optical system 3, and guiding the development device housing a corresponding color toner to the position opposing the photoreceptor drum 1. Then, the respective charged color toners are successively supplied from each of the development devices 4Y, 4M, 4C and 4Bk to perform development.

In the image forming apparatus of FIG. 2, an endless intermediate transfer belt 7 is provided on the downstream side in the rotation direction of the photoreceptor drum 1 from the development device unit 40 and is rotated in synchronization with the photoreceptor drum 1. The intermediate transfer belt 7 is in contact with the photoreceptor drum 1 with being pressed by a primary transfer roller 5 to transfer the toner image formed on the photoreceptor drum 1. A secondary rotating transfer roller 73 is provided opposite a support roller 72 to support the intermediate transfer belt 7 and a toner image carried on the intermediate transfer belt 7 is transferred onto a recording material P such as recording paper by being pressed at the site opposing the secondary transfer roller 73.

Between the full-color developing device unit 40 and the intermediate transfer belt 7, a cleaner 8 to remove any residual toner remained on the intermediate transfer belt 7 is provided with being detachable from the intermediate transfer belt 7.

A paper feeding means 60 for guiding the recording material (P) to the intermediate transfer belt 7 is constituted of a paper-feeding tray 61 housing recording material P, a paper-feeding 62 to feed the recording material P housed in the paper-feeding tray 61, sheet-by-sheet and a timing roller 63 to transfer the fed recording material P to the secondary transfer site.

The recording material P onto which a toner image has been transferred by being pressed is conveyed to a fixing device 24 through a conveyance means 66 constituted of an air-suction belt or the like, after which the transferred toner image is fixed on the recording material P in the fixing device 24. After fixing, the recording material P is conveyed through vertical conveyance route 80 and discharged onto the upper surface of apparatus body 100.

The image forming apparatus of FIG. 2 performs image formation with loading an exchangeable development device 4. A development device 4 shown in FIG. 3*a*, which is usually also called a toner cartridge, contains a prescribed amount of a toner within it where parts such as a developing roller are disposed. A development device, supplied in a cartridge form is mounted at a prescribed position within the image forming apparatus and supplies the contained developer to the photoreceptor drum to perform development. When no more developer remains after performing image formation of prescribed sheets, the cartridge is detached from the device and a new cartridge is loaded.

Figure 3:
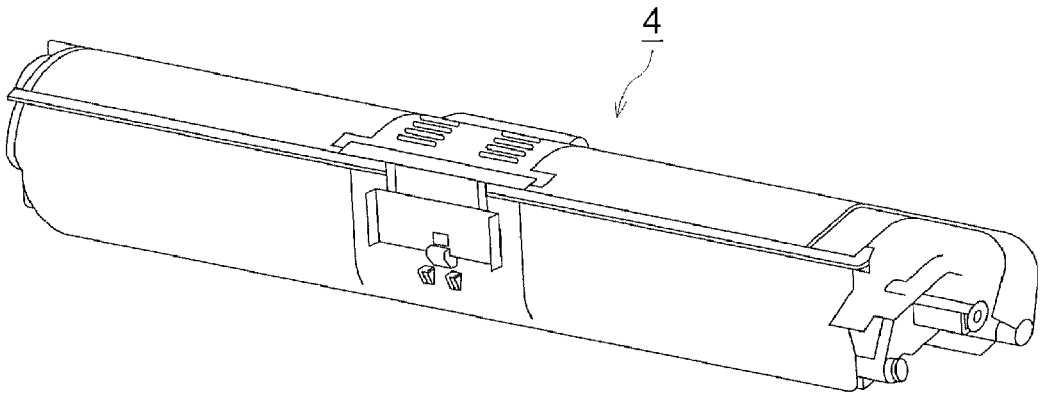
FIG. 3*a* illustrates a development device which is usually also called a toner cartridge.
FIG. 3*b* shows a sectional view of the development device.
Figure 3:
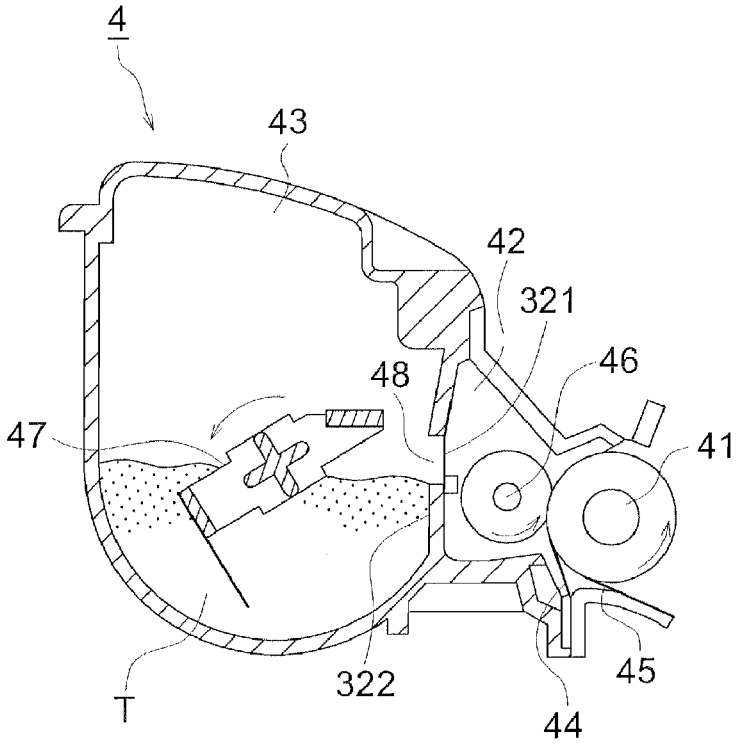

FIG. 3*b* illustrates a sectional view of the development device 4. Hereinafter, the development device 4 is also denoted as a toner cartridge 4. The toner cartridge 4 is provided with a buffer chamber 42 adjacent to a development roller 41 and a hopper 43 adjacent to the buffer chamber 42.

The development roller 41 is comprised of a conductive cylindrical substrate and an elastic layer formed of a hard material such as silicone rubber on the periphery of the substrate.

In the buffer chamber 42 is disposed a blade 44 as a toner controlling member with being pressed to the development roller 41. The blade 44 controls the electrostatic charge and the amount of toner applied onto the development roller 41. An auxiliary blade 45 to control the electrostatic charge and the amount of toner applied onto the development roller 41 may be provided downstream of the blade 41 with respect to the rotation of the development roller 41.

The development roller 41 is pressed against a feed roller 46. The feed roller 46 is rotated by a motor in the same direction as the development roller 41 (counterclockwise). The feed roller 46 is provided with an electrically conductive cylindrical substrate and a foamed layer formed of a urethane foam or the like on the periphery of the substrate.

A hopper 43 houses a toner T as a single-component developer. The hopper 43 is provided with a rotor 47 to stirring the toner. The rotor 47 is provided with a film-form conveyance blade to convey toner by rotation of the rotor 47 in the arrowed direction. The toner fed by the conveyance blade is fed into the buffer chamber 42 through passage 44 provided in the wall separating the hopper 43 from the buffer chamber 42. The shape of the conveyance blade is formed so that the blade bends while conveying the toner at the front in the rotation direction of the blade and returned to the straight state when reaching the left-side end of the passage 48. Thus, the blade feeds the toner to the pass 48 by allowing its shape to be returned straight via the bent state.

There is provided a valve 321 in the passage 48 to close the passage 48. The valve is a film-form member and one end of the valve is fixed at the upper right-hand side of the pass 48 and when the toner is fed from the hopper 43 to the pass 48, the valve is pressed to the right side by the pressure of the toner to open the passage 48. As a result, the toner is fed into the buffer chamber 42.

Further, a control member 322 is provided at the other end of the valve 321. The feed roller 46 is disposed so that the valve 321 forms a slight opening even when the passage 48 is closed. The control member 322 can be adjusted so that toner is not excessively accumulated at the bottom of the buffer chamber 42. It is so controlled that a toner which is recovered to the feed roller 46 from the development roller 41 does not fall in a large amount to the bottom.

In the toner cartridge 4, the development roller 41 rotates in the arrowed direction during image formation, while toner in the buffer chamber 42 is fed onto the development roller 41 through rotation of the feed roller 46. The toner fed onto the development roller 41 is electrically charged and thin-layered by the blade 44 and the auxiliary blade 45 and is then conveyed to the region opposed to the image bearing body, whereby the latent image on the image bearing body is subjected to development. A toner unused in development is returned to the buffer chamber 42 through rotation of the development roller 41 and is scraped off from the development roller 41 to recover the toner.

The toner of the invention causes no variation in crystal structure of a colorant contained in the toner at a heating temperature at the time of fixing in the prior art and stably color-reproducible toner images can be obtained in a conventional fixing device. Recently, there has been a trend of reduced energy consumption of an image forming apparatus in concern of the global environment. Specifically, a designed reduction of energy consumption in the fixing stage has been noted and there have been introduced techniques of fixing a toner images at a lower temperature than conventionally, corresponding to so-called low-temperature fixing.

When employing the toner of the invention as a toner corresponding to low-temperature fixing, the surface temperature of a heating member in a fixing device is preferably controlled to less than 140° C., and more preferably to less than 130° C.

Under the above temperature, it is required to achieve an efficient supply of heat from the heating member to a transfer sheet, so that fixing by using a heat-resistant belt in either a heating member or a pressing member, so-called belt-fixing is preferred.

Figure 4:
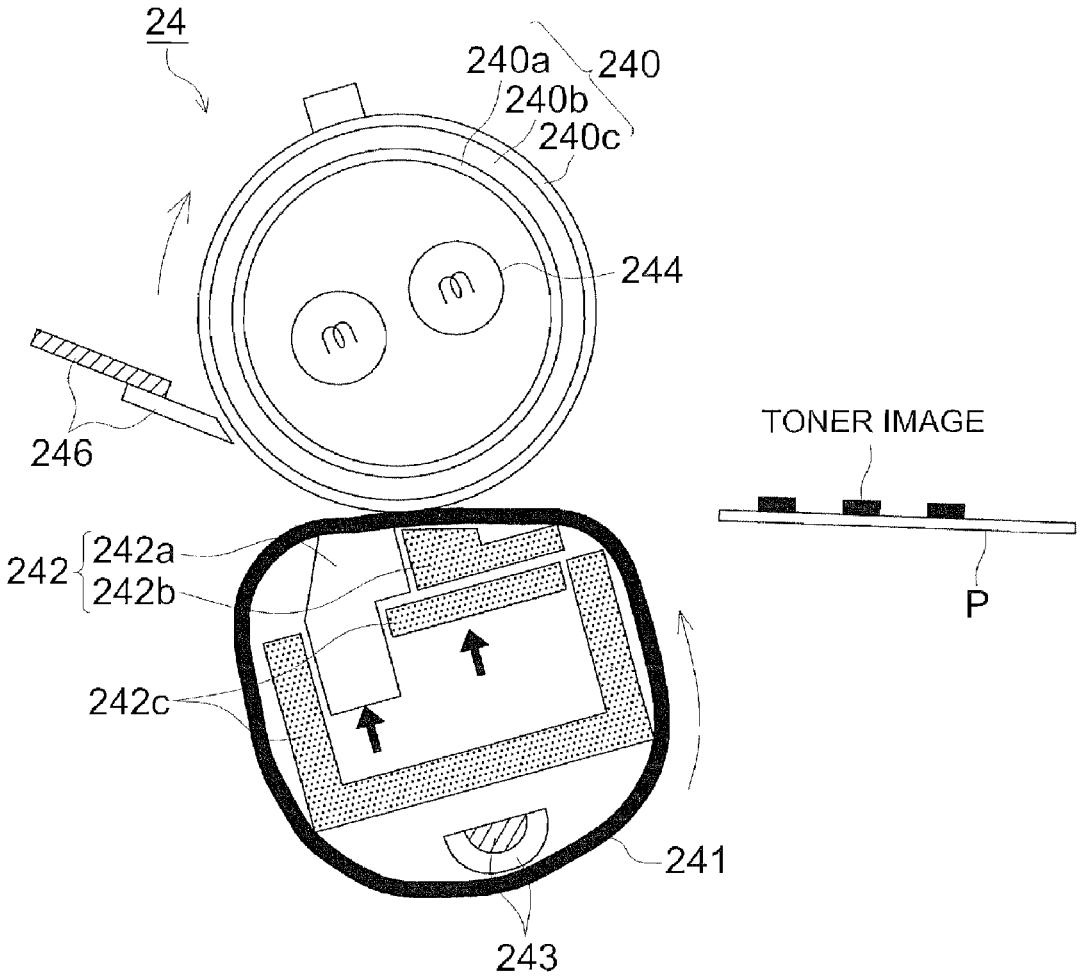
FIG. 4 illustrates an example of a fixing device of a belt-fixing system.

FIG. 4 illustrates a fixing device of a belt-fixing system (using a belt and a heating roller) capable of fixing the toner of the invention.

A fixing device 24 is a type of using a belt and a heating roller to create a nip, which is mainly formed of a fixing roller 240, a seamless belt 241, a pressure pad 242*a* (pressure member) and a pressure pad 242*b* (pressure member), and a lubricant-supplying member.

The fixing roller 240 is formed of a heat-resistant elastic layer 240*b* and a releasing layer 240*c* (heat-resistant resin layer) around a metal core 240*a* (cylindrical cored bar) and a halogen lamp 244 as a heating source is disposed inside the core 240*a*. The surface temperature of the fixing roller 240 is measured by a temperature sensor 245 and based on the measured signals, the halogen lamp 244 is feedback-controlled by a temperature controller not shown here, whereby the surface of the fixing roller 240 is controlled to a constant temperature. The seamless belt 241 is in contact with the fixing roller 240 so as to be wound at a prescribed angle and forms a nip.

Inside the seamless belt 241, a pressure pad 242 having a low-frictional surface layer is disposed with being pressed to the fixing roller 240 through the seamless belt 241. The pressure pad 242 is provided with the pressure pad 242*a* to which a high pressure is applied and the pressure pad 242*b* to which a low pressure is applied and is held by a metal holder 242*c*.

The holder 242*c* is fitted with a belt traveling guide so that the seamless belt 241 slides smoothly. The belt traveling guide, which rubs against the inside surface of the seamless belt 241, is preferably a member exhibiting a low friction coefficient and is also preferably low heat-conductive one to make it difficult to conduct heat away from the seamless belt 241. Examples of a material for the seamless belt 241 include a polyimide.

A toner image formed of the toner of the invention is finally transferred to a transfer material P and fixed on the transfer material to perform image formation. Transfer material P, which is a support to hold the toner image, is usually called an image support, a recording material or transfer paper. Specific examples thereof include plain paper and fine-quality paper including light and heavy paper, coated printing paper such as art paper or coated paper, commercially available Japanese paper or postcard paper, plastic film used for OHP and fabric.

EXAMPLES

The embodiments of the invention will be described with reference to examples but the invention is by no means limited to these.

1. Preparation of Toners 1-18

1-1. Preparation of Toner 1 (Kneading/Grinding Method)

The toner constitution described below was placed in a HENSCHEL MIXER (produced Mitsui-Miike Kogyo Co., Ltd.) and mixed with stirring at a blade-circumferential speed of 25 m/sec for 5 min.

| | |
|---|---|
| Polyester resin (condensation product of bisphenol A/ethylene oxide adduct, terephthalic acid and trimeritic acid) | 100 mass parts |
| Colorant I-1 | 2 mass parts |
| Releasing agent (pentaerythritol tetrastearate) | 6 mass parts |
| Charge controlling agent (boron dibenzylic acid) | 1 mass part |

The mixture was kneaded by a biaxial extrusion kneader, roughly ground by a hammer mill, further ground by a turbomill (produced by TURBO KOGYO Co., Ltd.) and was subjected to a fine powder classification treatment by a air classifier employing Coanda effect to obtain colored particles having a volume-based median diameter of 5.5 μm.

Next, to the foregoing colored particles were added external additives described below and subjected to an external treatment in a Henschel mixer to obtain Toner 1.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in HENSCHEL MIXER was conducted under conditions of a stirring blade circumferential speed of 35 m/sec, a treatment temperature of 35° C. and a treatment time of 15 min.

1-2. Preparation of Toners 2-18 (emulsion coagulation method)

(1) Preparation of colorant microparticle dispersion:

11.5 parts by mass of sodium n-dodecylsulfate was placed in 160 parts by mass of deionized water and dissolved with stirring to prepare an aqueous surfactant solution. To this aqueous surfactant solution was gradually added 2 parts by mass of colorant I-1 shown in Table 1 and dispersed by using CLEAR MIX W-motion CLM-0.8 (produced by M Technique Co.) to obtain colorant microparticle dispersion 1.

Colorant microparticle 1 contained in the colorant microparticle dispersion 1 exhibited a volume-based median diameter of 98 nm. The volume-based median diameter was measured by using MICROTRAC UPA-150 (produced by HONEYWELL Corp.) under the following condition:

| | |
|---|---|
| Sample refraction index: | 1.59 |
| Sample specific gravity: | 1.05 (equivalent converted to spherical particle) |
| Solvent refraction index: | 1.33 |
| Solvent viscosity: | 0.797 (30° C.), 1.002 (20° C.) |
| Zero-point adjustment: | prepared by adding deionized water to a measurement cell. |

(2) Preparation of core resin particle 1:

Core resin particle 1 having a multilayer structure was prepared by the process of 1st polymerization, 2nd polymerization and 3rd polymerization steps.

(a) 1st polymerization:

Into a reaction vessel fitted with a stirrer, a temperature sensor, a condenser and a nitrogen gas-introducing device was added 4 parts by mass of anionic surfactant (formula I) together with 3040 parts by mass of deionized water to prepare an aqueous surfactant solution.

$$C_{10}H_{21}(OCH_2CH_2)_2SO_3Na \qquad \text{Formula I}$$

To the foregoing aqueous surfactant solution was added a polymerization initiator solution of 10 parts by weight of potassium persulfate (KPS) dissolved in 400 parts by weight of deionized water and after the temperature was raised to 75° C., a mixed monomer solution comprised of the following compounds was dropwise added to the reaction vessel in 1 hr.

| | |
|---|---|
| Styrene | 532 mass parts |
| n-Butyl acrylate | 200 mass parts |
| Methacrylic acid | 68 mass parts |
| n-Octylmercaptane | 16.4 mass parts |

After completing addition of the foregoing monomer solution, the reaction mixture was heated with stirring at 75° C. for 2 hrs. to undergo polymerization (1st polymerization) to obtain resin particles. The obtained resin particles were designated as particulate resin A1. The weight-average molecular weight of the particulate resin A1 was 16,500.

(b) 2nd polymerization:

To a flask fitted with a stirrer was added a mixed monomer solution of compounds describe below and subsequently, 93.8 parts by weight of paraffin wax HNP-57 (produced Nippon Seiro Co., Ltd.) as a releasing agent was added and dissolved with heating at 90° C. to prepare a monomer solution.

| | |
|---|---|
| Styrene | 101.1 mass parts |
| n-Butyl acrylate | 62.1 mass parts |
| Methacrylic acid | 12.3 mass parts |
| n-Octylmercaptane | 1.75 mass parts |

An aqueous surfactant solution was prepared by dissolving 3 parts by mass of the foregoing anionic surfactant in 1560 parts by mass of deionized water and heated at 98° C. To this aqueous surfactant solution was added the foregoing particulate resin A1 in an amount of 32.8 parts by mass (equivalent converted to solids), and the paraffin wax-containing monomer solution described above was added and was dispersed for 8 hrs. using a mechanical stirrer having a circulation pass, CLEARMIX (produced by M Technique Co.). There was thus prepared an emulsified particle dispersion comprised of emulsion particles having a dispersion particle size of 340 nm.

Subsequently, to the foregoing emulsified particle dispersion was added a polymerization initiator solution of 6 parts by mass of potassium persulfate dissolved in 200 parts by mass of deionized water. This reaction mixture was heated at 98° C. for 12 hrs. to undergo polymerization (2nd polymerization) to prepare resin particles. The thus prepared resin particles were designated as particulate resin A2. The weight-average molecular weight of the particulate resin A2 was 23,000.

(c) 3rd Polymerization:

To the particulate resin A2 obtained in the 2nd polymerization step was added a polymerization initiator solution of 5.45 parts by mass of potassium persulfate dissolved in 220 parts by mass of deionized water and a mixed monomer solution composed of the following compounds was dropwise added to the reaction vessel at 80° C. in 1 hr.

| | |
|---|---|
| Styrene | 293.8 mass parts |
| n-Butyl acrylate | 154.1 mass parts |
| n-Octylmercaptane | 7.08 mass parts |

After completing addition, the reaction mixture was heated with stirring for 2 hrs. to undergo polymerization (3rd polymerization). After completing polymerization, the reaction mixture was cooled to 28° C. to obtain core resin particle 1. The weight-average molecular weight of the core resin particle 1 was 26,800.

(3) Preparation of Shell Resin Particle:

Shell resin particle 1 was prepared similarly to the foregoing core resin particle 1, provided that the composition of the monomer solution used in the 1st polymerization step was changed as below.

| | |
|---|---|
| Styrene | 624 mass parts |
| 2-Ethylhexyl acrylate | 120 mass parts |
| Methacrylic acid | 56 mss parts |
| n-Octylmercaptane | 16.4 mass parts |

Preparation of Toner 2

Toner 2 was prepared in the following manner.

(a) Formation of Core:

Into a reaction vessel fitted with a stirrer, a temperature sensor, a condenser and a nitrogen gas introducing device was placed the following composition:

| | |
|---|---|
| Core resin particle | 420.7 mass parts (equivalent converted to solid) |
| Deionized water | 900 mass parts |
| Colorant particle dispersion 1 | 200 mass parts |

The interior of the reaction vessel was adjusted to 30° C. and the pH was adjusted to 8-11 with an aqueous 5 mol/L sodium hydroxide solution.

Subsequently, further thereto, an aqueous solution of 2 parts by mass of magnesium chloride hexahydrate dissolved in 1000 parts by weight of deionized water was added at 30° C. for 10 min. After allowed to stand for 3 min., the mixture was heated to 65° C. in 60 min. to perform coagulation. Using Multisizer 3 (Coulter Co.), the dispersion was measured as such with respect to coagulated particle size and when coagulated particles reached a volume-based median diameter of 5.5 μm, there was added an aqueous solution of 40.2 parts by mass of sodium chloride dissolved in 1000 parts by mass of deionized water to terminate coagulation.

After terminating coagulation, ripening was conducted at 70° C. for 1 hr. to allow fusion to continue, whereby core 1 was prepared. The average circularity of the core 1, which was measured by FPIA 2000 (produced by Sysmex Co.), was 0.912.

(b) Formation of Shell:

Next, to the foregoing solution maintained at 65° C. was added 96 parts by mass of shell resin particle 1. Further thereto, an aqueous solution of 2 parts by mass of magnesium chloride hexahydrate dissolved in 1000 parts by mass of deionized water was added in 10 min. and the reaction mixture was heated to 70° C. and stirred for 1 hr. Thus, the shell resin particle 1 was melted onto the surface of the core 1 and ripening was carried out for 20 min to form a shell.

Thereafter was added an aqueous solution of 40.2 parts by mass of sodium chloride dissolved in 1000 parts by mass to terminate shell formation. The reaction mixture was cooled to 30° C. at a cooling rate of 8° C./min. The colored particles thus formed were filtered off and repeatedly washed with deionized water of 45° C., and dried with hot air of 40° C. to prepare colored particle 2 having a shell on the core surface.

(c) External Additive Treatment:

The colored particle 2 was added with the following external additives and subjected to an external treatment with stirring in a Henschel mixer to prepare toner 2.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in a Henschel mixer was conducted under conditions of a stirring blade circumferential speed of 35 m/sec, a treatment temperature of 35° C. and a treatment time of 15 min.

(5) Preparation of Toners 3-18

Toners 3-18 were prepared similarly to the toner 2, provided that colorant I-1 was replaced by colorants shown in Table 2.

1-3. Preparation of Comparative Toners 1 and 2

(1) Preparation of Comparative Toner 1

Comparative toner 1 (Comp. 1) was prepared similarly to the foregoing toner 2, provided that the colorant I-1 was replaced by a copper phthalocyanine compound prepared in the following manner.

Preparation of Copper Phthalocyanine Compound:

Into a reaction vessel fitted with a condenser, a stirrer, a thermometer and a heater were placed compounds described below:

| | |
|---|---|
| Anhydrous phthalic acid | 21.0 mass parts |
| Urea | 23.0 mass parts |
| Anhydrous cuprous chloride | 3.6 mass parts |
| Ammonium molybdate | 0.007 mass parts |
| tert-butylxylene* | 100 mass parts |

(*mixture comprising tert-butyl-o-xylene as a main component, and further containing tert-butyl-m-xylene and tert-butyl-p-xylene)

After completion of reaction, the reaction mixture was cooled and the reaction product was filtered off under reduced pressure. The recovered reaction was placed in 400 parts by mass of methanol, washed and filtered. Washing with methanol and filtration were repeated twice.

After removing methanol, the filtered reaction product was placed in 4000 parts by mass of an aqueous 2% sodium hydroxide solution, washed with boiling for 1 hr. and filtered. After filtration, washing with hot water was repeated until washing water was neutralized. There was thus obtained a copper phthalocyanine compound.

(2) Preparation of Comparative Toner 2

Comparative toner 2 (Comp. 2) was prepared similarly to the foregoing toner 2, provided that the colorant 1 was replaced by a colorant disclosed in JP-A No. 5-239368, as shown below.

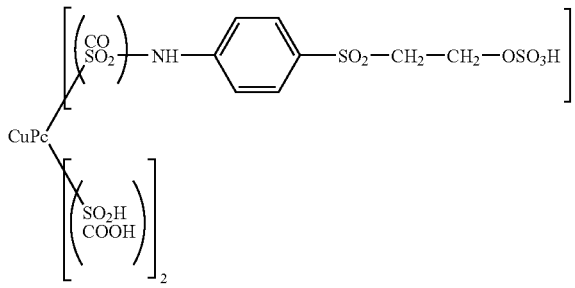

Pc: phthalocyanine moiety 1-4. Preparation of Developers 1-18, Comparative Developers 1-2

Each of the toners 1-18 and comparative toners 1 and 2 was mixed with ferrite carrier particles having silicone covered and exhibiting a volume average particle size of 60 μm to prepare developers 1-18 and comparative developers 1 and 2, each having a toner content of 6%.

2. Evaluation

Evaluation was conducted using a commercially available, multi-functional printer, bizhub Pro C500 (produced by Konica Minolta Business Technology Inc.) corresponding to an image forming apparatus of a two-component development system, as illustrated in FIG. 1, in which a development device was charged with each of the developers.

Further, a fixing device of a belt-type fixing system, as illustrated in FIG. 4 was installed in the printer to conduct evaluation. Conditions in the fixing-type device of a belt fixing system were as follows:

| | |
|---|---|
| Fixing speed: | 230 mm/sec |
| Surface material of heating roller: | polytetrafluoro-ethylene (PTFE) |
| Surface temperature of heating roller: | 125° C. |

Evaluation was made under an environment of ordinary temperature and humidity (20° C., 55% RH) with respect to the evaluation items described below.

Under an ordinary temperature and ordinary humidity (25° C., 55% RH) were printed 3,000 A4 sheets composed of four equal parts of a halftone image having an image density of 0.4, a solid white image, a solid black image having a density of 0.8 and a fine-line image.

Color Contamination:

A solid image sample and a 10 gradation scale sample having 10-graded densities were subjected to human sensory examination, based on the following criteria. Total points submitted by 10 examiners were used for the evaluation. Theoretically, the maximum was 30 points and the minimum (not exceeding the conventional level) is zero. The following point-criteria were employed:

3 points for a solid image being clearly finished and giving no sense of color contamination, and a 10-step gradation scaled image having finished with no feeling of color contamination in the middle tones;

2 points for a solid image being slightly inferior to that of 3 points but exhibiting no sense of color contamination, and a 10-step gradation scaled image exhibiting a finish with no sense of color contamination in the middle tones;

1 point for a solid image and a 10-step gradation scaled image having finished with feeling of an advance but being inferior to the 2-point image;

0 point for: a solid image and a 10-step gradation scaled image being substantially equivalent to the image color of conventional toners and exhibiting no feeling of an advance.

Lightfastness:

Solid image samples were each subjected to exposure over a period of ten days in a xenon fadometer (70,000 lux) and lightfastness was evaluated based on reflection density variation between before and after exposure. Image densities before and after exposure in the fadometer were measured by using color reflection densitometer X-Rite 404A (produced by X-Rite Co.). A density difference of 1.0 or less was evaluated acceptable.

Toner Consumption:

Using each of toners, 2000 A4 sheets of monochromatic images printed at a pixel ratio of 6% were produced and based on the amount of toner consumed during printing, toner consumption per printed sheet was calculated and evaluated. Toner consumption of less than 16 mg/sheet was evaluated acceptable.

Results are shown in Table 2

TABLE 2

| | Toner No. (developer No.) | Toner preparation | Colorant no. | Color contamination (point) | Lightfastness | Toner consumption (mg/sheet) |
|---|---|---|---|---|---|---|
| Example 1 | 1 | *1 | I-1 | 26 | 0.04 | 8 |
| Example 2 | 2 | *2 | I-1 | 28 | 0.02 | 7 |
| Example 3 | 3 | *2 | I-2 | 25 | 0.06 | 7 |
| Example 4 | 4 | *2 | I-3 | 27 | 0.03 | 8 |
| Example 5 | 5 | *2 | I-4 | 25 | 0.05 | 11 |
| Example 6 | 6 | *2 | I-5 | 25 | 0.06 | 12 |
| Example 7 | 7 | *2 | III-1 | 27 | 0.03 | 7 |
| Example 8 | 8 | *2 | IV-1 | 26 | 0.04 | 11 |
| Example 9 | 9 | *2 | I-7 | 25 | 0.05 | 8 |
| Example 10 | 10 | *2 | I-8 | 25 | 0.06 | 8 |
| Example 11 | 11 | *2 | I-9 | 25 | 0.04 | 11 |
| Example 12 | 12 | *2 | I-11 | 25 | 0.05 | 12 |
| Example 13 | 13 | *2 | I-13 | 23 | 0.07 | 12 |

TABLE 2-continued

| | Toner No. (developer No.) | Toner preparation | Colorant no. | Color contamination (point) | Lightfastness | Toner consumption (mg/sheet) |
|---|---|---|---|---|---|---|
| Example 14 | 14 | *2 | I-14 | 22 | 0.08 | 11 |
| Example 15 | 15 | *2 | II-1 | 22 | 0.08 | 11 |
| Example 16 | 16 | *2 | II-2 | 24 | 0.06 | 12 |
| Example 17 | 17 | *2 | II-3 | 22 | 0.07 | 12 |
| Example 18 | 18 | *2 | V-1 | 22 | 0.08 | 14 |
| Comparative Example 1 | Comp. 1 | *2 | | 1 | 0.06 | 23 |
| Comparative Example 2 | Comp. 2 | *2 | | 12 | 0.48 | 24 |

*1: kneading/grinding method
*2: emulsion coagulation method

As shown in Table 2, it was proved that Examples 1-18 attained superior results with respect to the foregoing evaluation items, leading to advantages of the invention. It was further proved that Comparative Examples 1 and 2 failed to achieve advantageous results attained by examples of the invention.

What is claimed is:

1. An electrostatic image developing toner, wherein the toner comprises a binding resin and a colorant, and the colorant comprises a compound represented by formula (I):

formula (I)

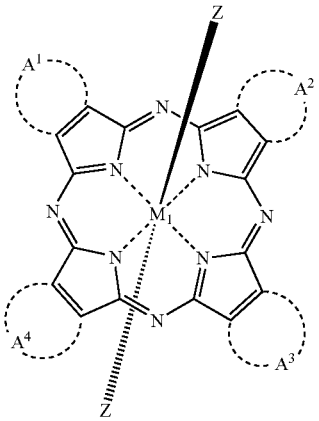

wherein $M_1$ is a silicon atom, Z is a group represented by formula (VI):

formula (VI)

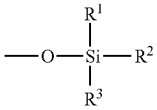

wherein $R^1$, $R^2$ and $R^3$ are each an alkyl group having 1 to 22 carbon atoms, and $A^1$, $A^2$, $A^3$ and $A^4$ are each independently an atomic group selected from the group consisting of (1) to (29)

(1)

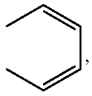

(2)

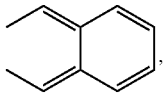

(3)

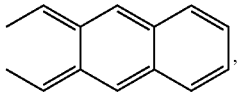

(4)

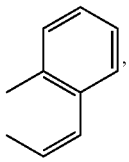

(5)

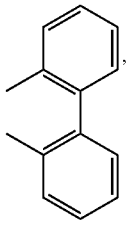

(6)

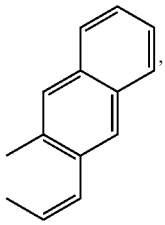

(7)

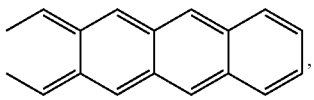

(8)

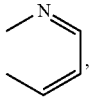

-continued (9)

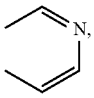

(10)

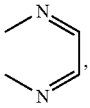

(11)

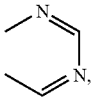

(12)

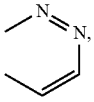

(13)

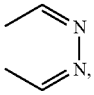

(14)

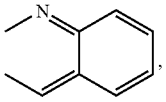

(15)

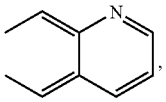

(16)

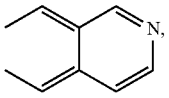

(17)

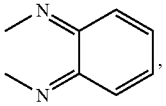

(18)

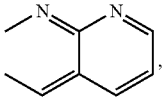

(19)

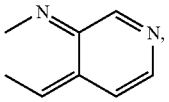

(20)

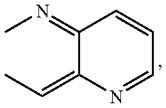

(21)

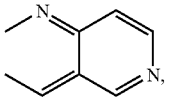

-continued (22)

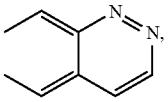

(23)

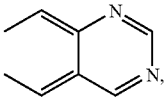

(24)

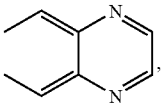

(25)

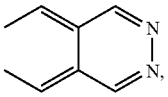

(26)

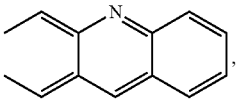

(27)

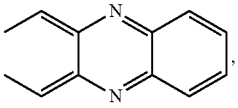

(28)

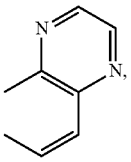

(29)

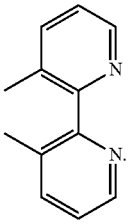

2. The toner of claim 1, wherein the toner contains the colorant in an amount of 1 to 30% by mass of the toner.

3. The toner of claim 1, wherein the toner comprises toner particles having a coefficient of variation in volume-based particle size distribution of 2 to 21%.

4. The toner of claim 1, wherein the toner exhibits a softening point of 70 to 110° C.

5. An electrostatic image developing toner, wherein the toner comprises a binding resin and a colorant, and the colorant comprises a compound represented by formula (III):

formula (III)

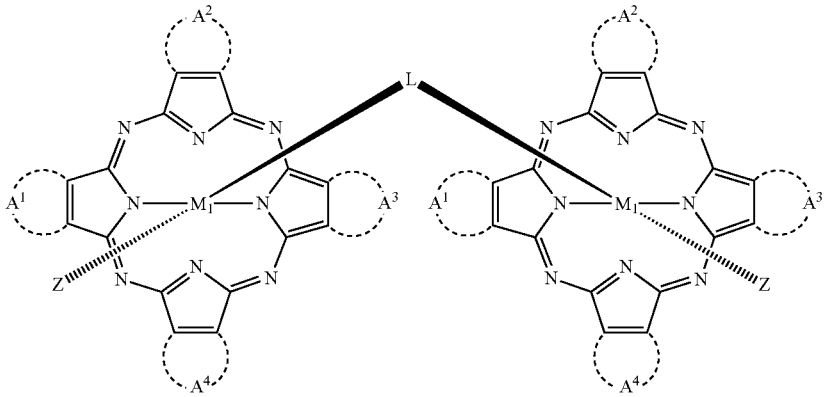

wherein $M_1$ is a silicon atom, L is an oxygen atom or —O—Si(R)$_2$—O— in which R is an alkyl group having 1 to 4 carbon atom, a chlorine atom or a hydroxy group; Z is a group represented by formula (VI):

formula (VI)

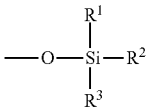

wherein $R^1$, $R^2$ and $R^3$ are each an alkyl group having 1 to 22 carbon atoms; and $A^1$, $A^2$, $A^3$ and $A^4$ are each independently an atomic group selected from the group consisting of (1) to (29)

(1)

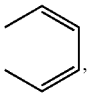

(2)

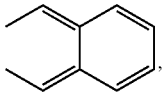

(3)

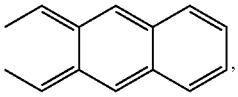

(4)

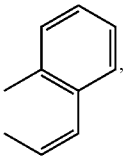

(5)

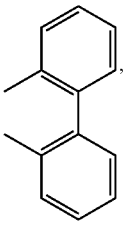

-continued (6)

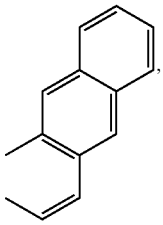

(7)

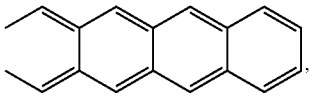

(8)

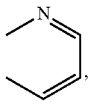

(9)

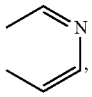

(10)

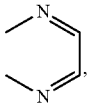

(11)

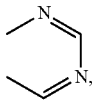

(12)

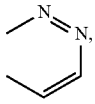

(13)

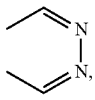

-continued (14)

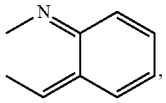

(15)

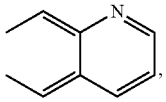

(16)

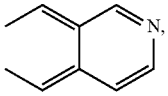

(17)

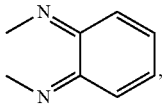

(18)

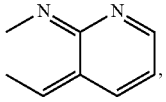

(19)

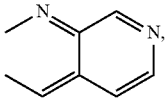

(20)

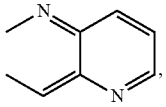

(21)

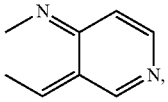

(22)

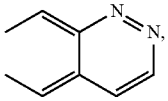

(23)

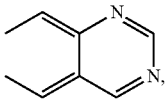

-continued (24)

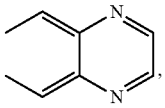

(25)

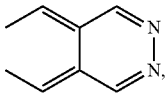

(26)

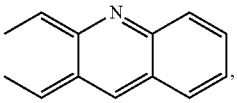

(27)

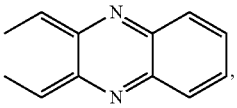

(28)

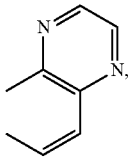

(29)

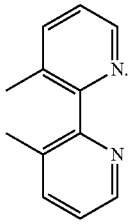

6. The toner of claim 5, wherein the toner contains the colorant in an amount of 1 to 30% by mass of the toner.

7. The toner of claim 5, wherein the toner comprises toner particles having a coefficient of variation in volume-based particle size distribution of 2 to 21%.

8. The toner of claim 5, wherein the toner exhibits a softening point of 70 to 110° C.

9. An electrostatic image developing toner, wherein the toner comprises a binding resin and a colorant, and the colorant comprises a compound represented by formula (IV):

formula (IV)

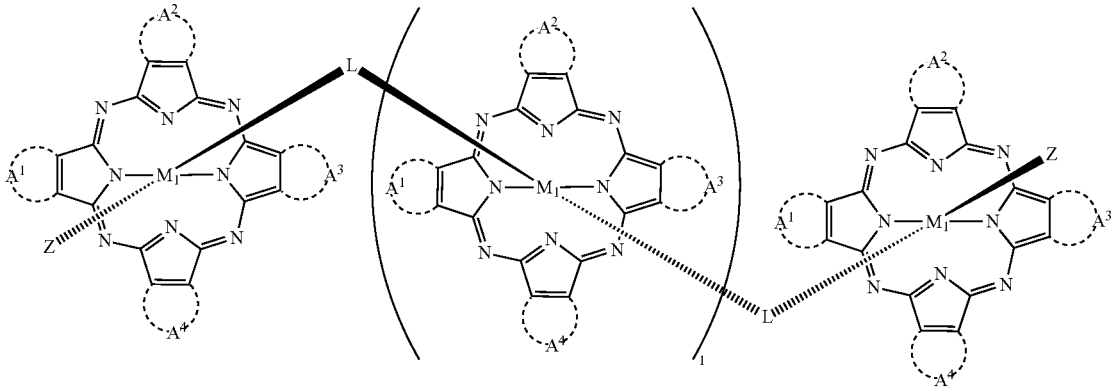

wherein $M_1$ is a silicon atom, Z is a group represented by formula (VI):

formula (VI)

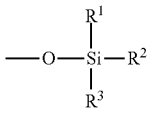

wherein $R^1$, $R^2$ and $R^3$ are each an alkyl group having 1 to 22 carbon atoms; L is an oxygen atom or —O—$Si(R)_2$—O— in which R is an alkyl group having 1 to 4 carbon atom, a chlorine atom or a hydroxy group; and $A^1$, $A^2$, $A^3$ and $A^4$ are each independently an atomic group selected from the group consisting of (1) to (29)

(1)

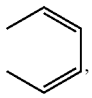

(2)

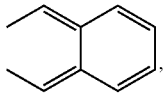

(3)

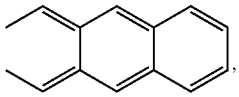

(4)

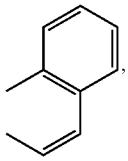

(5)

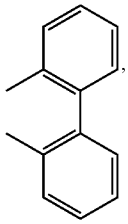

(6)

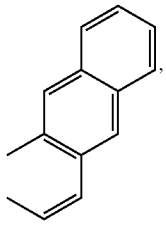

(7)

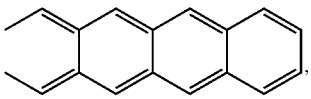

(8)

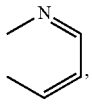

-continued (9)

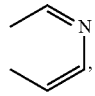

(10)

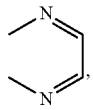

(11)

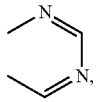

(12)

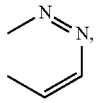

(13)

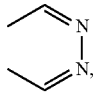

(14)

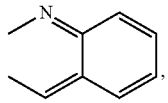

(15)

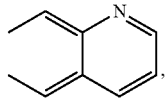

(16)

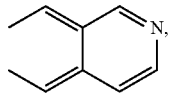

(17)

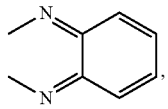

(18)

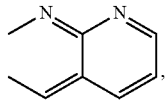

(19)

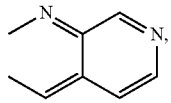

(20)

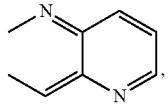

(21)

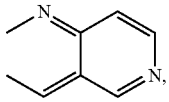

(22)

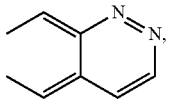

-continued
(23)
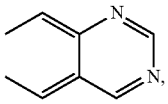
(24)
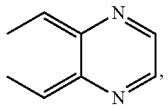
(25)
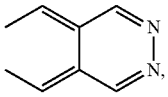
(26)
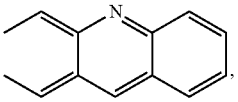
(27)
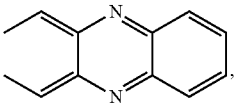
-continued
(28)
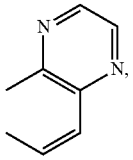
(29)
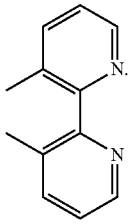
10. The toner of claim 9, wherein the toner contains the colorant in an amount of 1 to 30% by mass of the toner.
11. The toner of claim 9, wherein the toner comprises toner particles having a coefficient of variation in volume-based particle size distribution of 2 to 21%.
12. The toner of claim 9, wherein the toner exhibits a softening point of 70 to 110° C.
* * * * *